US012089704B2

(12) United States Patent
Kane

(10) Patent No.: US 12,089,704 B2
(45) **Date of Patent: *Sep. 17, 2024**

(54) COMPACT WALLET

(71) Applicant: The Ridge Wallet LLC, Santa Monica, CA (US)

(72) Inventor: Daniel Kane, Agoura Hills, CA (US)

(73) Assignee: The Ridge Wallet LLC, Santa Monica, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/107,955

(22) Filed: Feb. 9, 2023

(65) Prior Publication Data

US 2023/0189949 A1 Jun. 22, 2023

Related U.S. Application Data

(63) Continuation of application No. 18/076,188, filed on Dec. 6, 2022, which is a continuation of application
(Continued)

(51) Int. Cl.
*A45C 1/06* (2006.01)
*A45C 1/08* (2006.01)
(Continued)

(52) U.S. Cl.
CPC ..... *A45C 1/06* (2013.01); *A45C 1/08* (2013.01); *A45C 11/182* (2013.01);
(Continued)

(58) Field of Classification Search
CPC ..... A45C 1/06; A45C 1/08; A45C 11/182; A45C 13/185; A45C 2001/062;
(Continued)

(56) References Cited

U.S. PATENT DOCUMENTS 11,348 A 7/1854 Andrews
D29,232 S 8/1898 Byrnes
(Continued)

FOREIGN PATENT DOCUMENTS

CN 304692057 S 6/2018
CN 306789903 8/2021
(Continued)

OTHER PUBLICATIONS

Ridge Wallet 2.0 comment section, https://www.kickstarter.com/projects/124039987/the-bridge-front-pocket-wallet/comments (Year: 2013).*

(Continued)

*Primary Examiner* — Tri M Mai
(74) *Attorney, Agent, or Firm* — K&L Gates LLP; Brian J. Novak; Giorgios N. Kefallinos

(57) ABSTRACT

There is disclosed a compact wallet, comprising at least two rigid plates at least one having a channel into which an encircling elastic band is interposed to bias the at least two rigid plates inwardly and securely hold the card-like contents while providing elastic volume therebetween while allowing freedom for the dynamic extension and contraction of the band over the entire running length of the wallet. The wallet includes an auxiliary feature removably attached within the interior at least one of the at least two rigid plates interposed using a tang inserted into a recess formed inside the plate, the tang having a hook, the hook extending at an angle to the tang, the hook engaging an undercut of the recess to prevent inadvertent dislodgement of the auxiliary feature from the recess.

14 Claims, 7 Drawing Sheets

Related U.S. Application Data

No. 17/490,201, filed on Sep. 30, 2021, now abandoned, which is a continuation of application No. 17/035,261, filed on Sep. 28, 2020, now Pat. No. 11,596,212, which is a continuation of application No. 15/421,596, filed on Feb. 1, 2017, now Pat. No. 10,791,808, which is a continuation-in-part of application No. 14/706,019, filed on May 7, 2015, now abandoned.

(51) Int. Cl.
*A45C 11/18* (2006.01)
*A45C 13/18* (2006.01)

(52) U.S. Cl.
CPC ..... *A45C 13/185* (2013.01); *A45C 2001/062* (2013.01); *A45C 2001/065* (2013.01); *A45C 2001/083* (2013.01); *A45C 2011/186* (2013.01)

(58) Field of Classification Search
CPC ..... A45C 2001/065; A45C 2001/083; A45C 2011/186
See application file for complete search history.

(56) References Cited

U.S. PATENT DOCUMENTS

D30,701 S 5/1899 Haslup
D32,985 S 7/1900 Musselman
881,757 A 3/1908 Winsor
1,525,745 A 2/1925 Keefer
2,322,461 A 6/1943 Mariano
2,409,019 A 10/1946 Cree
D168,398 S 12/1952 Gazan
D173,148 S 10/1954 Emmite
3,139,977 A 7/1964 Richard
D206,783 S 1/1967 McCormick
D221,412 S 8/1971 Laughlin
4,141,400 A 2/1979 Mangan
4,477,928 A 10/1984 Graff
4,675,953 A 6/1987 Higgs
D301,017 S 5/1989 Norman
4,918,299 A 4/1990 Ohmori
D314,865 S 2/1991 Tuisku
5,038,985 A 8/1991 Chapin
5,077,869 A 1/1992 Haase
5,103,884 A 4/1992 Roman
5,249,437 A 10/1993 Cole
5,328,026 A * 7/1994 Newman ..... A45C 11/24 206/37.1
5,540,367 A 7/1996 Kauker
D372,358 S 8/1996 Mathison
5,617,751 A 4/1997 Song
D383,701 S 9/1997 Fletcher
D385,417 S 10/1997 White et al.
D390,493 S 2/1998 Fletcher
D393,813 S 4/1998 Herdt
D400,466 S 11/1998 Gleason
5,944,080 A 8/1999 Podwika
5,952,637 A 9/1999 Strunk
6,044,967 A 4/2000 Painsith
6,094,747 A 8/2000 Malick
D431,341 S 9/2000 DiPaolo et al.
D435,340 S 12/2000 Kojoori
D461,427 S 8/2002 Braner
D463,055 S 9/2002 Layne
D492,351 S 6/2004 Sato
D505,337 S 5/2005 Cooper
6,962,253 B1 11/2005 McZeek
D512,835 S 12/2005 Hunter, Jr. et al.
6,971,147 B2 12/2005 Halstead
D534,584 S 1/2007 Goldberg
D537,752 S 3/2007 Goldberg
D538,704 S 3/2007 Kaminski
D561,469 S 2/2008 Jensen et al.
7,334,616 B2 2/2008 Kaminski
D576,912 S 9/2008 Yuengling
D591,044 S 4/2009 Lakhiani
7,527,081 B2 5/2009 Coates
D596,508 S 7/2009 Warren
D613,293 S 4/2010 Sheba
D620,785 S 8/2010 Germaine
7,810,683 B2 10/2010 Chan
D628,795 S 12/2010 Sanders
D632,695 S 2/2011 Berntsen
D647,810 S 11/2011 Bohrer
D653,967 S 2/2012 Blake
8,255,018 B2 8/2012 Plaster
D676,618 S 2/2013 Kalbach
8,381,360 B2 2/2013 Preston-Hall
D677,193 S 3/2013 MacDonald
D679,618 S 4/2013 Dumas
D690,931 S 10/2013 Minn et al.
8,567,460 B1 10/2013 Lentsch
D695,013 S 12/2013 Minn et al.
D703,267 S 4/2014 Harvey Pennaz
8,726,952 B2 * 5/2014 Jambunathan ..... A45C 11/00 150/147
D707,584 S 6/2014 Webb
D710,741 S 8/2014 Hirschorn
D716,043 S 10/2014 Wilk
D717,197 S 11/2014 Kinskey
8,914,949 B2 12/2014 Thomson et al.
D721,610 S 1/2015 Tavone
D721,945 S 2/2015 Underkofler
D730,225 S 5/2015 Behar
D739,778 S 9/2015 Vu et al.
9,125,464 B2 9/2015 Minn et al.
D740,155 S 10/2015 Vang
D751,889 S 3/2016 Thiltges
9,314,074 B2 4/2016 Johnson et al.
9,404,291 B1 8/2016 White
D768,114 S 10/2016 Hou
D768,383 S 10/2016 Wu
D768,635 S 10/2016 Due
D769,143 S 10/2016 Warren
D770,775 S 11/2016 Robertson, III
D795,252 S 8/2017 Chung et al.
D811,730 S 3/2018 Pullum
9,907,371 B2 3/2018 Ross
D814,184 S 4/2018 Parsons
D835,410 S 12/2018 Chan et al.
D844,322 S 4/2019 Bo
D851,928 S 6/2019 Moore
D860,645 S 9/2019 Wu
D866,962 S 11/2019 Parsons
D866,964 S 11/2019 Tran et al.
D867,757 S 11/2019 Justiss
D868,463 S 12/2019 Tran et al.
10,529,258 B1 1/2020 Brown et al.
D878,039 S 3/2020 Cantoli-Alves et al.
D884,338 S 5/2020 Liu
D887,132 S 6/2020 Puglisi
D895,963 S 9/2020 Anderson
D896,506 S 9/2020 Anderson
10,791,808 B2 10/2020 Kane
D902,194 S 11/2020 Gluck
D903,312 S 12/2020 Bauer et al.
D904,386 S 12/2020 Luo
D934,560 S 11/2021 Tran et al.
D936,505 S 11/2021 Umair
D938,165 S 12/2021 Schillings
D940,689 S 1/2022 Feng
D951,632 S 5/2022 Tran et al.
D954,435 S 6/2022 Yang
D956,415 S 7/2022 Tran et al.
D960,017 S 8/2022 Wu
D961,252 S 8/2022 Mng
11,399,608 B2 8/2022 Huang et al.
11,420,316 B2 8/2022 Liang et al.
D964,735 S 9/2022 Zeng
D970,887 S 11/2022 Kalbach
D972,841 S 12/2022 Tran et al.
D974,346 S 1/2023 Xie

(56) References Cited

U.S. PATENT DOCUMENTS

| | | | | |
|---|---|---|---|---|
| D974,945 | S | 1/2023 | Deng | |
| D975,998 | S | 1/2023 | Yang | |
| D976,576 | S | 1/2023 | Sirichai | |
| D976,582 | S | 1/2023 | Del Moral et al. | |
| D976,583 | S | 1/2023 | Wu | |
| D977,831 | S | 2/2023 | Zeng | |
| D978,530 | S | 2/2023 | Lu | |
| D979,936 | S | 3/2023 | Zeng | |
| 11,596,212 | B2 | 3/2023 | Kane | |
| D982,900 | S | 4/2023 | Goldstein | |
| D983,520 | S | 4/2023 | Zeng | |
| D1,000,830 | S | 10/2023 | Wang | |
| D1,002,192 | S | 10/2023 | Wang | |
| 11,793,283 | B1 | 10/2023 | Zhang | |
| D1,003,599 | S | 11/2023 | Sande et al. | |
| D1,007,146 | S | 12/2023 | Lin | |
| 11,839,277 | B1 | 12/2023 | Peng | |
| 2004/0103500 | A1 | 6/2004 | Ward | |
| 2005/0023157 | A1 | 2/2005 | Logan | |
| 2006/0076094 | A1 | 4/2006 | Kaminski | |
| 2006/0237107 | A1 | 10/2006 | Speck | |
| 2008/0083829 | A1 | 4/2008 | Lowe | |
| 2008/0178976 | A1 | 7/2008 | Lakhiani | |
| 2009/0094795 | A1 | 4/2009 | Lazarus | |
| 2009/0211062 | A1 | 8/2009 | Preston-Hall | |
| 2010/0139049 | A1 | 6/2010 | Glickfield | |
| 2011/0308972 | A1 | 12/2011 | Streem | |
| 2012/0180917 | A1 | 7/2012 | Armstrong | |
| 2013/0206055 | A1 | 8/2013 | Moran Wexler | |
| 2013/0276943 | A1 | 10/2013 | Minn | |
| 2014/0233181 | A1 | 8/2014 | Harms | |
| 2015/0059936 | A1* | 3/2015 | Singer | A45C 13/023 442/131 |
| 2015/0059937 | A1* | 3/2015 | Singer | A45C 1/06 206/38.1 |
| 2015/0083289 | A1 | 3/2015 | Johnson | |
| 2015/0335113 | A1 | 11/2015 | Minn et al. | |
| 2015/0342314 | A1 | 12/2015 | Christy | |
| 2016/0022000 | A1 | 1/2016 | Tucker-Skow et al. | |
| 2016/0324283 | A1 | 11/2016 | Kane | |
| 2017/0065047 | A1 | 3/2017 | Van Der Laan | |
| 2018/0027935 | A1 | 2/2018 | Laatz | |
| 2019/0208046 | A1 | 7/2019 | Gluck | |
| 2019/0375087 | A1 | 12/2019 | Liang et al. | |
| 2019/0380458 | A1 | 12/2019 | Muldowney, Jr. | |
| 2020/0337426 | A1 | 10/2020 | Huang et al. | |
| 2021/0337945 | A1 | 11/2021 | Popoff | |
| 2022/0240635 | A1 | 8/2022 | Timpson et al. | |
| 2023/0284758 | A1 | 9/2023 | Espartero | |
| 2023/0413962 | A1 | 12/2023 | Kane | |

FOREIGN PATENT DOCUMENTS

| | | | |
|---|---|---|---|
| CN | 306806204 | | 9/2021 |
| CN | 307103944 | | 2/2022 |
| CN | 307863259 | | 2/2023 |
| DM | 219325 | | 3/2022 |
| EM | 008644611-0001 | | 8/2021 |
| EM | 008934491-0001 | | 4/2022 |
| EM | 008934491-0002 | | 4/2022 |
| EM | 008944177-0003 | | 4/2022 |
| EM | 015001951-0001 | | 11/2022 |
| EM | 015001951-0002 | | 11/2022 |
| EM | 015001953-0001 | | 11/2022 |
| EM | 015001953-0002 | | 11/2022 |
| EP | 0251900 | B1 | 7/1990 |
| EP | 4070683 | A1 | 10/2022 |
| EP | 4079183 | A1 | 10/2022 |
| GB | 2069659 | | 5/1997 |
| GB | 6198997 | | 3/2022 |
| HK | 2219606-0002 | | 7/2022 |
| JP | D1736723 | | 2/2023 |
| JP | D1736774 | | 2/2023 |
| KR | 3011929570002 | | 11/2022 |
| KR | 3011929580003 | | 11/2022 |
| KR | 3011929580004 | | 11/2022 |
| KR | 3011929580005 | | 11/2022 |
| WO | 2016/179586 | A1 | 11/2016 |

OTHER PUBLICATIONS

*Mosaic Brands, Inc.* v. *Ridge Wallet LLC*, Case Nos. 22-1001, -1002 (Fed. Cir. Dec. 20, 2022) (Year: 2022).*

U.S. Appl. No. 18/117,238, filed Mar. 3, 2023.

U.S. Appl. No. 18/126,279, filed Mar. 24, 2023.

U.S. Appl. No. 18/126,336, filed Mar. 24, 2023.

Third-Party Submission under 37 CFR 1.290, filed in U.S. Appl. No. 29/812,273, filed Apr. 17, 2023.

The Ridge: Front Pocket Wallet (Kickstarter), Published May 23, 2013, URL: <https://www.kickstarter.com/projects/124039987/the-bridge-front-pocket-wallet>, archived by the Wayback Machine, URL: <https://web.archive.org/web/20130523102304/https://www.kickstarter.com/projects/124039987 /the-bridge-front-pocket-wallet>.

Smart Money Clip (Storus), Published Sep. 26, 2016, URL: <https://www.storus.com>, archived by the Wayback Machine, URL: <https://web.archive.org/web/20160926120005/http://www.storus.com/>.

URL: <https://www.grid-wallet.com/>, Published Jan. 29, 2018, archived by the Wayback Machine, URL: <https://web.archive.org/web/20180129191446/https:/ www.grid-wallet.com/>.

URL: <https://www.grid-wallet.com/>, Published Aug. 26, 2018, archived by the Wayback Machine, URL: <https://web.archive.org/web/20180826165157 /https:// www .grid-wallet.com/>.

Customer Review Published Jun. 13, 2021, Screenshot Retrieved on Apr. 10, 2023. URL: <https://www.amazon.com/Minimalist-Wallet-Blocking-Alnminnm-Carbon/dp/B08YWHFIQ7/ref=sr_1_3_sspa?hvadid=3455422 | 5411&hvdev=c&hvlocphF9015370&hvnem=g&hvqmt=e&hvrand= 12l407242409255013 3l&hvtargid=kwd-746235658781 &hydad cr=8375 _9905011 &keywords=donword%2Bslim%2Bwallet&qid= | 68 | 135503&sr=8-3-.

Third-Party Submission under 37 CFR 1.290, filed in U.S. Appl. No. 29/812,274, filed Apr. 17, 2023.

Third-Party Submission under 37 CFR 1.290, filed in U.S. Appl. No. 29/813,522, filed Apr. 17, 2023.

Third-Party Submission under 37 CFR 1.290, filed in U.S. Appl. No. 29/813,523, filed Apr. 17, 2023.

Third-Party Submission under 37 CFR 1.290, filed in U.S. Appl. No. 29/813,524, filed Apr. 17, 2023.

Third-Party Submission under 37 CFR 1.290, filed in U.S. Appl. No. 29/813,525, filed Apr. 17, 2023.

Third-Party Submission under 37 CFR 1.290, filed in U.S. Appl. No. 29/813,527, filed Apr. 17, 2023.

Third-Party Submission under 37 CFR 1.290, filed in U.S. Appl. No. 29/813,529, filed Apr. 17, 2023.

Third-Party Submission under 37 CFR 1.290, filed in U.S. Appl. No. 29/813,530, filed Apr. 17, 2023.

Third-Party Submission under 37 CFR 1.290, filed in U.S. Appl. No. 29/813,531, filed Apr. 17, 2023.

Third-Party Submission under 37 CFR 1.290, filed in U.S. Appl. No. 29/813,532, filed Apr. 17, 2023.

Third-Party Submission under 37 CFR 1.290, filed in U.S. Appl. No. 29/813,533, filed Apr. 17, 2023.

Third-Party Submission under 37 CFR 1.290, filed in U.S. Appl. No. 29/813,537, filed Apr. 17, 2023.

Third-Party Submission under 37 CFR 1.290, filed in U.S. Appl. No. 29/813,615, filed Apr. 17, 2023.

Third-Party Submission under 37 CFR 1.290, filed in U.S. Appl. No. 29/813,617, filed Apr. 17, 2023.

Third-Party Submission under 37 CFR 1.290, filed in U.S. Appl. No. 29/813,624, filed Apr. 17, 2023.

Third-Party Submission under 37 CFR 1.290, filed in U.S. Appl. No. 29/813,625, filed Apr. 17, 2023.

Third-Party Submission under 37 CFR 1.290, filed in U.S. Appl. No. 29/813,626, filed Apr. 17, 2023.

Third-Party Submission under 37 CFR 1.290, filed in U.S. Appl. No. 29/813,628, filed Apr. 17, 2023.

(56) References Cited

OTHER PUBLICATIONS

Third-Party Submission under 37 CFR 1.290, filed in U.S. Appl. No. 29/812,250, filed Apr. 17, 2023.
Third-Party Submission under 37 CFR 1.290, filed in U.S. Appl. No. 29/812,251, filed Apr. 17, 2023.
Third-Party Submission under 37 CFR 1.290, filed in U.S. Appl. No. 29/812,253, filed Apr. 17, 2023.
Third-Party Submission under 37 CFR 1.290, filed in U.S. Appl. No. 29/812,255, filed Apr. 17, 2023.
Third-Party Submission under 37 CFR 1.290, filed in U.S. Appl. No. 29/812,258, filed Apr. 17, 2023.
Third-Party Submission under 37 CFR 1.290, filed in U.S. Appl. No. 29/812,260, filed Apr. 17, 2023.
Third-Party Submission under 37 CFR 1.290, filed in U.S. Appl. No. 29/812,263, filed Apr. 17, 2023.
Third-Party Submission under 37 CFR 1.290, filed in U.S. Appl. No. 29/812,268, filed Apr. 17, 2023.
Third-Party Submission under 37 CFR 1.290, filed in U.S. Appl. No. 29/812,269, filed Apr. 17, 2023.
Third-Party Submission under 37 CFR 1.290, filed in U.S. Appl. No. 29/822,078, filed Apr. 17, 2023.
Shenzhen Pincan Technology Co., Ltd.—Petition for Inter Partes Review of U.S. Pat. No. 10,791,808, dated Jan. 2, 2024, IPR2024-00340, United States Patent Trial and Appeal Board, and exhibits thereto (2024).
Tribe Ultralight Wallet Unboxing and Review—Slim Wallet Junkie, accessed, URL: https://www.youtube.com/watch?v=las3zqULdBk, Jun. 27, 2015.
U.S. Appl. No. 29/875,909, filed May 12, 2023.
U.S. Appl. No. 29/875,910, filed May 12, 2023.
U.S. Appl. No. 29/883,115, filed Jan. 24, 2023.
U.S. Appl. No. 29/883,116, filed Jan. 24, 2023.
U.S. Appl. No. 29/888,639, filed Apr. 3, 2023.
U.S. Appl. No. 29/888,734, filed Apr. 4, 2023.
U.S. Appl. No. 29/894,477, filed Jun. 9, 2023.
U.S. Appl. No. 29/894,998, filed Jun. 15, 2023.
U.S. Appl. No. 29/895,097, filed Jun. 16, 2023.
U.S. Appl. No. 29/896,573, filed Jul. 5, 2023.
U.S. Appl. No. 29/896,574, filed Jul. 5, 2023.
U.S. Appl. No. 29/896,575, filed Jul. 5, 2023.
U.S. Appl. No. 29/898,357, filed Jul. 26, 2023.
U.S. Appl. No. 29/898,360, filed Jul. 26, 2023.
U.S. Appl. No. 29/898,361, filed Jul. 26, 2023.
U.S. Appl. No. 29/898,352, filed Jul. 26, 2023.
U.S. Appl. No. 29/898,353, filed Jul. 26, 2023.
U.S. Appl. No. 29/898,354, filed Jul. 26, 2023.
U.S. Appl. No. 29/919,214, filed Dec. 1, 2023.
U.S. Appl. No. 29/919,216, filed Dec. 1, 2023.
U.S. Appl. No. 29/919,218, filed Dec. 1, 2023.
U.S. Appl. No. 18/241,741, filed Sep. 1, 2023.
"Smart Wallet", archived by WayBack Machine on Aug. 28, 2016, www.storus.com, site visited Nov. 22, 2023: https://web.archive.org/web/20160828215330/http:/www.storus.com/ (Year:2016).
Delila Minimalist Slim Wallet for Men, available to the public no later than Jun. 20, 2021 based on customer photo review, amazon.com [online], [site visited Dec. 13, 2023], Available at URL: https://www.amazon.com/dp/B0CFPYJXL5/?t1 (Year:2021).
"Ridge Wallet Review" (KICKSTARTER) Jul. 21, 2014, Retrieved from the Internet on Jul. 8, 2016, URL: <http://kickstarter. reviews/ridge-wallet-2/>.
"3m Bonding Tapes" (3M) Oct. 30, 2014. Retrieved from the Internet on Jul. 11, 2016, URL:<https://web.archive.org/web/20141030183241/http://www.ameyagroup.co.in/pdf/product%>.
U.S. Pat. No. 11,348 A, dated Jul. 25, 1854 (cited by Examiner in related applications, U.S. Appl. No. 14/706,019 and U.S. Appl. No. 14/706,019 (Inventor: Solomon Andrews)).
Ridge Wallet KickStarter Campaign found at https://www.kickstarter.com/projects/124039987/the-bridge-front-pocket-wallet, Jan. 2013.
The Ridge Wallet 2.0, https://www.kickstarter.com/projects/124039987/the-ridge-wallet-20, 36 pages (2013).
U.S. Appl. No. 29/813,614, filed Oct. 29, 2021.
U.S. Appl. No. 29/813,624, filed Oct. 29, 2021.
U.S. Appl. No. 29/813,628, filed Oct. 29, 2021.
U.S. Appl. No. 29/822,078, filed Jan. 5, 2022.
U.S. Appl. No. 29/813,617, filed Oct. 29, 2021.
International Search Report and Written Opinion, mailed Aug. 19, 2016, for International Application No. PCT/2016/031472.
*Mosaic Brands, Inc.* v. *The Ridge Wallet LLC* Appeal Index, Case No. 2:20-cv-04556-AB-JC (1703 pp.); appeal regarding, inter alia, finding of anticipation for U.S. Pat. No. 10,791,808 (2020).
U.S. Appl. No. 17/490,201, filed Sep. 30, 2021.
U.S. Appl. No. 18/076,188, filed Dec. 6, 2022.
*Mosaic Brands, Inc.* v. *The Ridge Wallet LLC.* Opinion of Federal Circuit Reversing Summary Judgment of Invalidity. Decided: Dec. 20, 2022.
U.S. Appl. No. 29/813,523, filed Oct. 29, 2021.
U.S. Appl. No. 29/813,524, filed Oct. 29, 2021.
U.S. Appl. No. 29/813,615, filed Oct. 29, 2021.
U.S. Appl. No. 29/813,620, filed Oct. 29, 2021.
U.S. Appl. No. 29/813,625, filed Oct. 29, 2021.
U.S. Appl. No. 29/812,250, filed Oct. 20, 2021.
U.S. Appl. No. 29/812,251, filed Oct. 20, 2021.
U.S. Appl. No. 29/812,273, filed Oct. 20, 2021.
U.S. Appl. No. 29/812,274, filed Oct. 20, 2021.
U.S. Appl. No. 29/813,522, filed Oct. 29, 2021.
U.S. Appl. No. 29/813,525, filed Oct. 29, 2021.
U.S. Appl. No. 29/813,527, filed Oct. 29, 2021.
U.S. Appl. No. 29/813,529, filed Oct. 29, 2021.
U.S. Appl. No. 29/813,530, filed Oct. 29, 2021.
U.S. Appl. No. 29/813,531, filed Oct. 29, 2021.
U.S. Appl. No. 29/813,532, filed Oct. 29, 2021.
U.S. Appl. No. 29/813,533, filed Oct. 29, 2021.
U.S. Appl. No. 29/813,537, filed Oct. 29, 2021.
U.S. Appl. No. 29/812,253, filed Oct. 20, 2021.
U.S. Appl. No. 29/812,255, filed Oct. 20, 2021.
U.S. Appl. No. 29/812,258, filed Oct. 20, 2021.
U.S. Appl. No. 29/812,260, filed Oct. 20, 2021.
U.S. Appl. No. 29/812,263, filed Oct. 20, 2021.
U.S. Appl. No. 29/812,264, filed Oct. 20, 2021.
U.S. Appl. No. 29/812,268, filed Oct. 20, 2021.
U.S. Appl. No. 29/812,269, filed Oct. 20, 2021.
U.S. Appl. No. 29/857,719, filed Oct. 25, 2022.
U.S. Appl. No. 29/811,291, filed Oct. 13, 2021.
The Ridge Wallet 2.0, youtube, https://www.youtube.com/watch?v=IJwHouB9cGY&t=21s, Oct. 10, 2013 (U.S. Appl. No. 17/035,261).
U.S. Appl. No. 29/837,653, filed May 6, 2022.
U.S. Appl. No. 29/837,654, filed May 6, 2022.
U.S. Appl. No. 29/813,626, filed Oct. 29, 2021.
U.S. Appl. No. 29/882,878, filed Jan. 19, 2023.
3D Printed Airtag Cash Clip—Aviator Wallet website: https://aviatorwallet.com/products/airtag-3d-printed-cashclip—5 pages (date of retrieval Nov. 11, 2022).
Airtag Carbon Case—the Ridge website: https://ridge.com/products/carbon-case-for-airtag—6 pages (date of retrieval Nov. 14, 2022).
Airtag Cash Strap—The Ridge website: https://ridge.com/products/airtag-cash-strap—8 pages (date of retrieval Nov. 13, 2022).
Airtag Dog Collar Case—Case-Mate website: https://case-mate.com/products/airtag-dog-collar-case-black—7 pages (date of retrieval Nov. 14, 2022).
Airtag Dog Collar Holder—Cyrill website: https://www.amazon.com/CYRILL-Airtag-Collar-Leather-Accessory/dp/B08C9MY9JV—9 pages (date of retrieval Nov. 2022).
Airtag Holder—Fantom X website: https://store.fantomwallet.com/fantom-x-airtag-holder/—7 pages (date of retrieval Nov. 14, 2022).
Airtag Money Clip—The Ridge website: https://ridge.com/products/airtag-money-clip—6 pages (date of retrieval Nov. 11, 2022).
Airtag Wallet Minimalist Holder—Borgasets Store website: https://www.amazon.com/Airtag-Wallet-Minimalist-Holder-Wallets/dp/B09TZTD2HY—6 pages (date of retrieval Nov. 14, 2022).
Declaration of Dr. Kimberly K. Cameron regarding Claim Construction of the '808 Patent, dated May 16, 2023. In the Matter of: Certain Compact Wallets and Components Thereof. Investigation

(56) References Cited

OTHER PUBLICATIONS

No. 337-TA-1355 (Enforcement Proceeding). United States International Trade Commission, Washington, D.C. (2023).
Donword Minimalist Wallet for Men RFID Blocking Aluminum Wallet Carbon Fiber Card Case Metal Wallet Minimalist Front Pocket Card Holder Cash Strap Mens Wallet (Black), photo reviewed on Jun. 13, 2021, Amazon.com, site visited Mar. 21, 2023: https://www.amazon.com/Minimalist-Wallet-Blocking-Aluminum-Carbon/dp/B08YXDVL5D/ref=cm_cr_arp_d_product_top?ie=UTF8&th=1 (Year: 2021).
Facebook post by The Ridge dated Dec. 21, 2016.
Facebook post by The Ridge dated Dec. 7, 2016.
Facebook post by The Ridge dated Jan. 11, 2016.
Facebook post by The Ridge dated Nov. 23, 2015.
Facebook post by The Ridge dated Nov. 13, 2015.
Facebook post by The Ridge dated Oct. 26, 2015.
Facebook post by The Ridge dated Oct. 23, 2015.
Facebook post by The Ridge dated Aug. 19, 2015.
Facebook post by The Ridge dated Aug. 19, 2014.
Facebook post by The Ridge dated Aug. 15, 2014.
Facebook post by The Ridge dated Feb. 5, 2015.
Facebook post by The Ridge dated Dec. 5, 2014.
Facebook post by The Ridge dated Nov. 20, 2014.
Facebook post by The Ridge dated Nov. 19, 2014.
Facebook post by The Ridge dated Nov. 6, 2014.
Facebook post by The Ridge dated Oct. 28, 2014.
Facebook post by The Ridge dated Oct. 13, 2014.
Facebook post by The Ridge dated Oct. 9, 2014.
Facebook post by The Ridge dated Sep. 24, 2014.
Facebook post by The Ridge dated Aug. 26, 2014.
Hayvenhurst Slim Wallet for Men—Front Pocket RFID Blocking Minimalist Wallet for Men—Metal Wallet With Money Clip for Men (Carbon Fiber), photo reviewed on Jun. 8, 2021, Amazon.com, site visited Mar. 22, 2023: https://www.amazon.com/RFID-Blocking-Slim-Wallet-Moneyclip-Metal-Wallet/dp/B091JH8P34/ref=cm_cr_arp_d_product_top?ie=UTF8&th=1 (Year: 2021).
Metal Airtag Holder—Aviator Wallet website: https://aviatorwallet.com/collections/aviator-wallet-accessoires/products/metal-airtag-cash-clips—4 pages (date of retrieval Nov. 14, 2022).
"Metal Wallets for men with Money Clip—Slim Minimalist Aluminum Wallet Credit Card Holder RFID Blocking (Cd Raised Grain, Black), photo review Jun. 20, 2019, Amazon.com, site visited Mar. 23, 2023: https://www.amazon.com/Metal-Minimalist-Wallet-Money-Clip/dp/B07JPHBLD1?th=1 (Year: 2019). "
"My Favorite Minimalist Aluminum Wallet, first available Sep. 14, 2019, youtube.com, site visited Mar. 22, 2023: https://www.youtube.com/watch?v=ul12aKtwXfk (Year: 2019).".
Notification of Reasons for Rejection, dated Jan. 17, 2023, for related Japanese Design Application No. 2022-007271.
Notification of Reasons for Rejection, dated Jan. 17, 2023, for related Japanese Design Application No. 2022-008280.
Notification of Reasons for Rejection, dated Jan. 17, 2023, for related Japanese Design Application No. 2022-008281.
Notification of Reasons for Rejection, dated Jan. 17, 2023, for related Japanese Design Application No. 2022-008282.
Notification of Reasons for Rejection, dated Jan. 17, 2023, for related Japanese Design Application No. 2022-008283.
Pet Collar Airtag Holder—Wasserstein website: https://wasserstein-home.com/products/wasserstein-pet-collar-airtag-holder-compatible-with-apple-airtag-protective-silicone-case-for-gps-tracker-2-pack-black-and-white—4 pages (date of retrieval Nov. 14, 2022).
Pluska Carbon Fiber Wallet, RFID Blocking Minimalist Aluminum Metal Money Clip Wallet, Easy Access Minimalist Wallet for Men, Front Pocket Card Holder, Slim Wallet, Preferred Gift, reviewed on Oct. 25, 2021, Amazon.com, site visited Mar. 21, 2023: https://www.amazon.com/PLUSKA-Wallet%EF%BC%8CRFID-Minimalist-Men%EF%BC%8CFront-Preferred/dp/B09FXFSZK8/ref=cm_cr_arp_d_product_top?ie=UTF8 (Year: 2021).
Pop-Up Card Holder—Slashare website: https://slashare.com/products/mens-pop-up-card-holder-rfid-wallet-airtag-holder-pu-leather-wallet—12 pages (date of retrieval Nov. 2022).
Rebuttal Declaration of Dr. Thomas R. Kurfess regarding Claim Construction of the '808 Patent, dated May 31, 2023. In the Matter of: Certain Compact Wallets and Components Thereof. Investigation No. 337-TA-1355 (Enforcement Proceeding). United States International Trade Commission, Washington, D.C. (2023).
RFID Blocking Front Pocket—Aluminum Slim Wallet/Travel Money Clip Credit Card Holder, first available Jan. 9, 2018, Amazon.com, site visited Mar. 22, 2023: https://www.amazon.com/RFID-Blocking-Front-Pocket-Aluminum/dp/B078X7HMC2/ref=cm_cr_arp_d_product_top?ie=UTF8 (Year: 2018).
Ridge Wallet Review, first available May 14, 2015, the-gadgeteer.com, site visited Mar. 23, 2023: https://the-gadgeteer.com/2015/05/14/ridge-wallet-review/ (Year: 2015).
Screw Heads Explained—With Kyle, first available Apr. 26, 2016, YouTube.com, site visited Mar. 23, 2023: https://www.youtube.com/watch?v=RF0EIIYesVE (Year: 2016).
The Ridge Minimalist Slim Wallet For Men—RFID Blocking Front Pocket Credit Card Holder—Aluminum Metal Small Mens Wallets with Cash Strap (Gunmetal), photo reviewed on Oct. 25, 2018, Amazon.com, site visited Mar. 21, 2023: https://www.amazon.com/Ridge-Authentic-Minimalist-Blocking-Wallet/dp/B01M5J3NB1/ref=cm_cr_arp_d_product_top?ie=UTF8&th=1 (Year: 2018).
The Ridge Wallet—Getting Started, first available Sep. 15, 2016, YouTube.com, site visited Mar. 22, 2023: https://www.youtube.com/watch?v=EBChreo_jdc (Year: 2016).
The Ridge Wallet—Removing/Installing the Money Clip, first available Sep. 22, 2016, The Ridge on YouTube.com, site visited Mar. 30, 2023: https ://www. youtube.com/watch?v=iTLzs-jNFJ8 (Year: 2016).
The Ridge Wallet 2.0, last updated Jan. 27, 2014, kickstarter.com, site visited Mar. 23, 2023: https://www.kickstarter.com/projects/124039987 /the-ridge-wallet-20?ref=discovery&term=ridge%20wallet (Year: 2014).
Kimberly K. Cameron Ph.D.—Expert Report of Dr. Kimberly K. Cameron Ph.D. Regarding Invalidity of U.S. Pat. No. 10,791,808, Dated Aug. 25, 2023, Served and Stricken in ITC Case No. 337-TA-1355, Washington DC, USA.
Dr. Thomas R. Kurfess—Rebuttal Expert Report of Dr. Thomas R. Kurfess Regarding Alleged Invalidity and Materiality, Dated Sep. 19, 2023, Served and Mooted in ITC Case No. 337-TA-1355, Washington DC, USA.
The Ridge Wallet 2.0 discussion, with comments with various times, along one comment by Brian Boyle, dated Mar. 1, 2014 (Year: 2014) (Feb. 26, 2024 in U.S. Appl. No. 18/126,279).
JETech Silicone Case for AirTag, Amazon.com, site visited Nov. 15, 2023: https:///www.amazon.com/JETech-Silicone-Compatible-Protective-Portable/dp/B0989XH127 (Year: 2018).
TenCloud Clip Holder for Airtags, Amazon.com, site visited Nov. 15, 2023: https:///www.amazon.com/TenCloud-Anti-Slip-Silicone-Protector-Portable/dp/B07D6Q49LZ (Year: 2021).
HONB Money Clip Credit Card, Amazon.com, retrieved Aug. 10, 2023: https://www.amazon.com/HONB-Credit-Holder-Stainless-Polished/dp/B076YN9YGP (Year: 2013).
Affidavit of Scott Kaminski dated Aug. 14, 2023 in Case No. 20-cv-04556-AB-JC in the United States District Court for the Central District of California.
Deposition transcript from Jun. 16, 2023 deposition of Mia Kaminski in USITC Case No. 337-TA-1355.
Affidavit of George R. Johnson dated Feb. 10, 2023 in Case No. 20-cv-04556-AB-JC in the United States District Court for the Central District of California.
Affidavit of Chris M. Lowe dated Feb. 10, 2023 in Case No. 20-cv-04556-AB-JC in the United States District Court for the Central District of California.
Joint Stipulations for Dismissal of Entire Action Pursuant to Fed. R. Civ. P. 41(a)(1)(A)(ii) in Case No. 20-cv-04556-AB-JC in the United States District Court for the Central District of California.

(56) References Cited

OTHER PUBLICATIONS

Slide Presentation from Techshow2023, dated 2023 and entitled "Evidentiary Use of the Temporal Web," by Nicholas Taylor and Joe Dugan.

* cited by examiner

COMPACT WALLET

This patent is a continuation of U.S. patent application Ser. No. 18/076,188 entitled "Compact Wallet" filed Dec. 6, 2022, which is a continuation of U.S. patent application Ser. No. 17/490,201 entitled "Compact Wallet" filed Sep. 30, 2021, which is a continuation of U.S. patent application Ser. No. 17/035,261 entitled "Compact Wallet" filed Sep. 28, 2020, now U.S. Pat. No. 11,596,212, which is a continuation of U.S. patent application Ser. No. 15/421,596, entitled "Compact Wallet" filed Feb. 1, 2017, now U.S. Pat. No. 10,791,808, which is a continuation-in-part of U.S. patent application Ser. No. 14/706,019 entitled "Compact Wallet" filed May 7, 2015, which has a Patent Cooperation Treaty counterpart filed as PCT/US16/31472 entitled "Compact Wallet" filed May 9, 2016, the entire disclosures each of which are incorporated herein by reference.

RELATED APPLICATION INFORMATION

This patent is a continuation of U.S. patent application Ser. No. 17/035,261 entitled "Compact Wallet" filed Sep. 28, 2020 which is a continuation of U.S. patent application Ser. No. 15/421,596, now U.S. Pat. No. 10,791,808 entitled "Compact Wallet" filed Feb. 1, 2017 which is a continuation-in-part of U.S. patent application Ser. No. 14/706,019 entitled "Compact Wallet" filed May 7, 2015 which has a Patent Cooperation Treaty counterpart filed as PCT/US16/31472 entitled "Compact Wallet" filed May 9, 2016.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to billfold wallets, and more particularly to low-profile wallets for credit cards.

Description of the Related Art

Who among us would not prefer a wallet minimally-sized to just the stack of credit cards carried in the typical bi- or tri-fold leather wallet? Such a minimalist wallet could be easily slipped into a shirt pocket, or present a slim profile in a pants pocket or purse.

Even with money clipped to it, the bulk of such a wallet would be less than that of the fold-over-envelope-type-wallet traditionally used to carry cards, money and identification. Such a traditional wallet, with its internal sleeves, compartments, and windows, not to mention contents, can bulge uncomfortably or telltale-like from clothing, or inconveniently in a handbag, while giving little protection from moisture, bending or electronic snooping.

In the lifestyle of today, purchases are made more and more with credit or debit cards or through electronic wallets, such as Apple Pay™ or Google Wallet™. Carrying cash, except for an emergency bill or two, has increasingly become both unnecessary and inconvenient in consideration of the nuisance in making change and risk of loss through theft or carelessness. The traditional wallet, initially designed to carry cash in bills, and sometimes coins and checks also, is correspondingly evolving into obsolescence in view of the convenience and record-keeping benefit of credit/debit cards. The bare essentials today are a charge card of some type and an item of identification, both, serendipitously, of generally the same size.

Money clips are common in the art and some money clips also made accommodation for credit cards. The clip, typically of hairpin-like configuration, has protrusion which can snag in a pocket of clothing or purse. Other known devices sandwich cards and/or money between bookend plates bound with elastic strapping. The strapping allows for an expandable interior volume while providing compression to grip the contents. The profile of the plates is generally larger than that of the contents, the out-sizing necessary to provide structure for either guiding the strapping or for fixtures to terminate the strapping. In most cases, the running length of the strapping is limited by the distance between fixture locations on the plates, which limits the expansion capability and, therefore, the capacity for contents. In other cases, it becomes difficult to view the stored contents without moving them all. In other cases, selectively withdrawing of just one of the contents, particularly with a presentation of the shorter edge, is frustrated by the compaction applied. In other cases, replacement of the straps when worn or stretched out is discouraged by assembly design. In other cases, the plates are of insufficient rigidity to protect the contents from bending.

The unfulfilled need is for a compact wallet which would be minimally dimensioned to the prototypical credit card profile. Such a compact wallet would be void of any potentially snagging structural appendages while optimizing volume expansion and view-ability of contents.

SUMMARY

The present invention utilizes bookend plates resiliently bound with an encircling elastic band to contain one or more credit card-sized objects in a wallet configuration. A novel feature maximizes the expansion of interior volume by allowing the strap to expand along a maximum length afforded by a longitudinal dimension of the wallet while avoiding anchor points which would effectively shorten the length. Another novel feature achieves minimal sizing of the plates by channeling the strap with interior means rather than by means of profile extensions. Yet another novel feature achieves easy access to, and viewing of, the contents through a cut-away feature which allows the contents to be partially pushed up where a fulcrum is provided for pinching the plates together and fanning out the contents.

It is, therefore, an object of the invention to provide a compact wallet substantially no larger than a credit card. It is a further object to maximize expandability of the wallet to accommodate multiple objects of substantially the same size. It is a further object to protect the contents of the wallet from damage or loss by open-ended drop through. It is a further object to facilitate selection of any one object from the bound group. It is a further object to accommodate folded currency handily on the outside of the wallet. It is a further object to present essentially smooth contours for snag-free passage into and out of pockets of clothing or bags. It is a further object to provide means and method for changing out elastic bounding bands. It is a further object to provide a method for making a compact wallet with different features attached thereto which can be modularly exchanged.

These objects, and others to become hereinafter apparent, are embodied in a compact wallet comprising, in a first element, at least two rigid plates interposed to sandwich card-like contents there between, each rigid plate having a longitudinal extent. A second element is at least one encircling elastic band interposed with the at least two rigid plates, over the longitudinal extents thereof, to bias them inwardly and securely hold the card-like contents while providing elastic volume between the plates for adding additional contents. A third element is a channeling means configured to minimize the profile of the wallet and hold position of the at least one encircling elastic band with respect to each rigid plate. The channeling means additionally allows freedom for the dynamic extension and contraction of the band over the entire running length of the band. With such means and in such manner, card-like contents may be carried with minimal silhouette on or with a person while allowing expandable capacity and ready access to individual contents from between the at least two rigid plates.

In a preferred embodiment, the channeling means is a longitudinal groove in a first lamina of a laminate construction of each rigid plate. The groove slidingly receives one part of the at least one encircling elastic band. In one instance of the preferred embodiment, a second lamina of the laminate construction of each rigid plate is removably attached to the first lamina to hold the at least one elastic band in capture and provide a smooth surface for glide purposes. In another instance, the second lamina is attached to the first lamina by screws.

In an alternate embodiment, a method of making a modular compact wallet comprises the steps of providing a compact wallet having at least two rigid plates each having a groove, at least one groove additionally having a recess, and at least one encircling elastic band interposed in the grooves to bias the plates inwardly; providing a first auxiliary feature having a tang; removably inserting the tang of the first auxiliary feature into the recess to attach the first auxiliary feature to an outside surface of at least one of the rigid plates; selectively removing the first auxiliary feature; selectively providing at least a second auxiliary feature having a tang; and removably inserting the tang of the second auxiliary feature into the recess to attach the second auxiliary feature to the outside surface.

As this is not intended to be an exhaustive recitation, other embodiments may be learned from practicing the invention or may otherwise become apparent to those skilled in the art.

DESCRIPTION OF THE DRAWINGS

Various other objects, features and attendant advantages of the present invention will become fully appreciated as the same becomes better understood through the accompanying drawings and the following detailed description, in which like reference characters designate the same or similar parts throughout the several views, and wherein.

DETAILED DESCRIPTION

Figure 1:
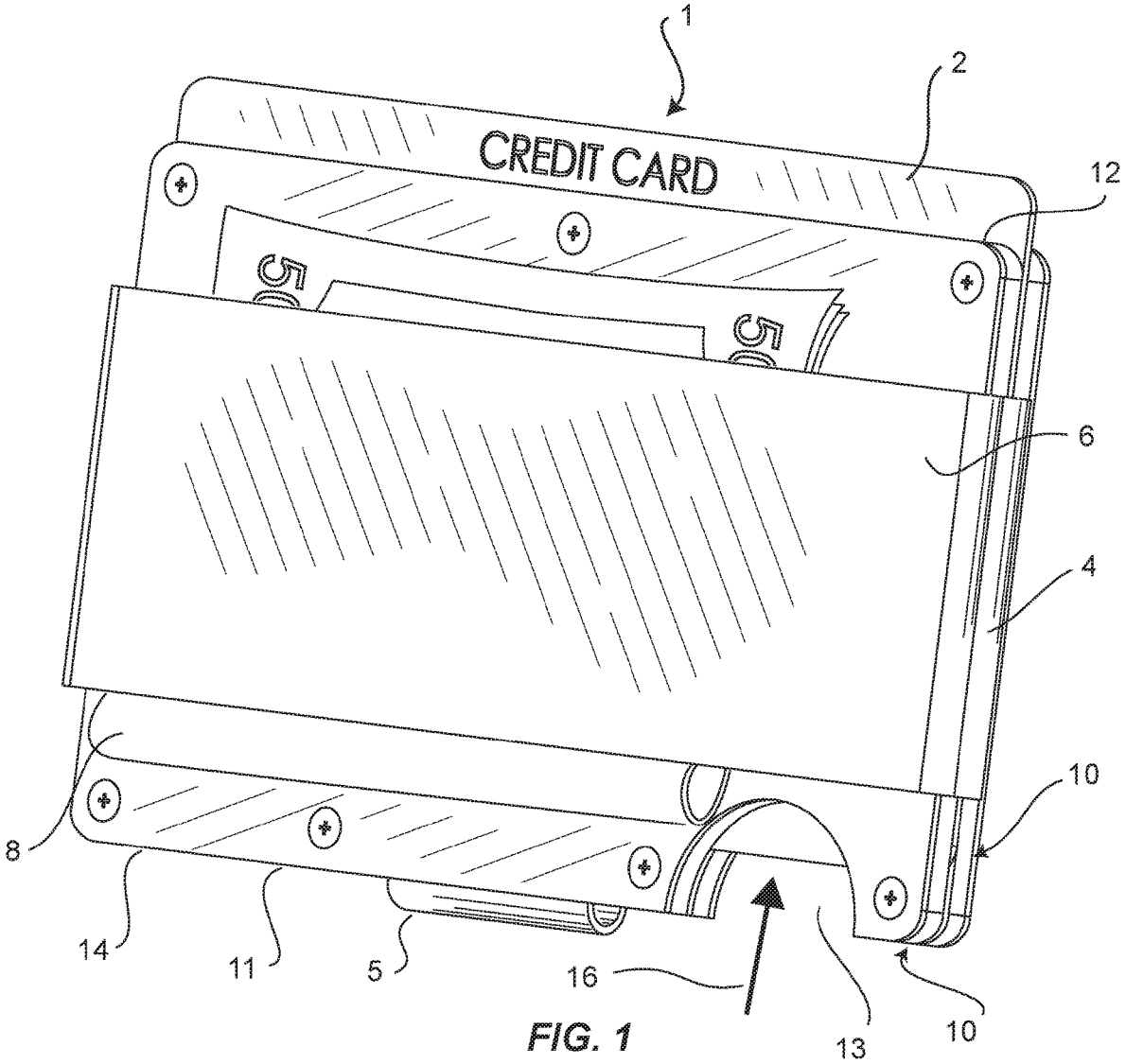
FIG. 1 is a perspective view of the compact wallet of the present invention showing currency banded to the outside thereof and a credit card extended into view by means of a finger notch.
Figure 2:
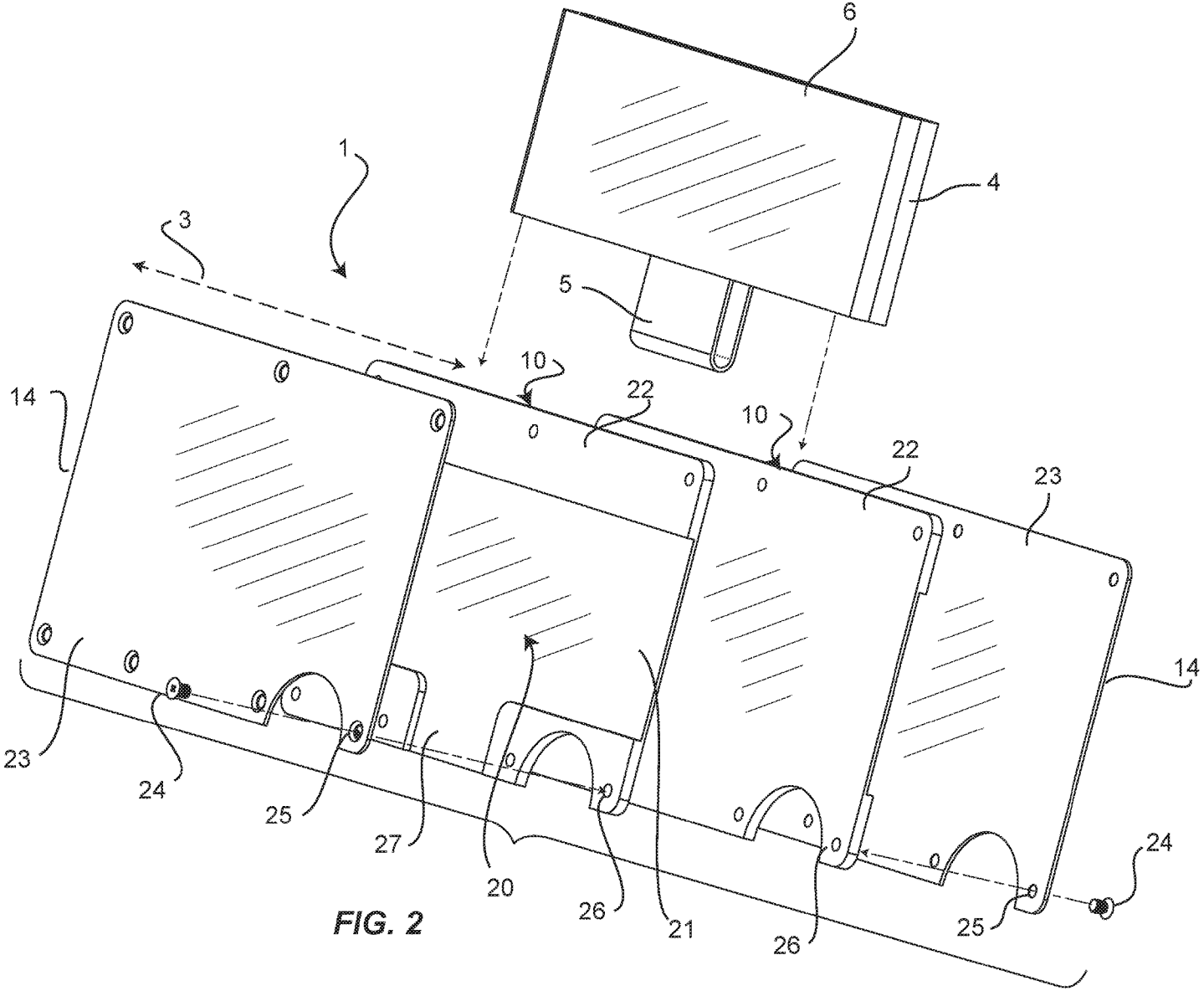
FIG. 2 is an exploded view of the compact wallet.
Figure 4:
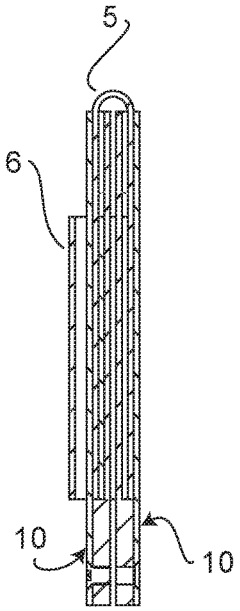
FIG. 4 is a section view taken along the lines 4-4 of FIG. 3.
Figure 3:
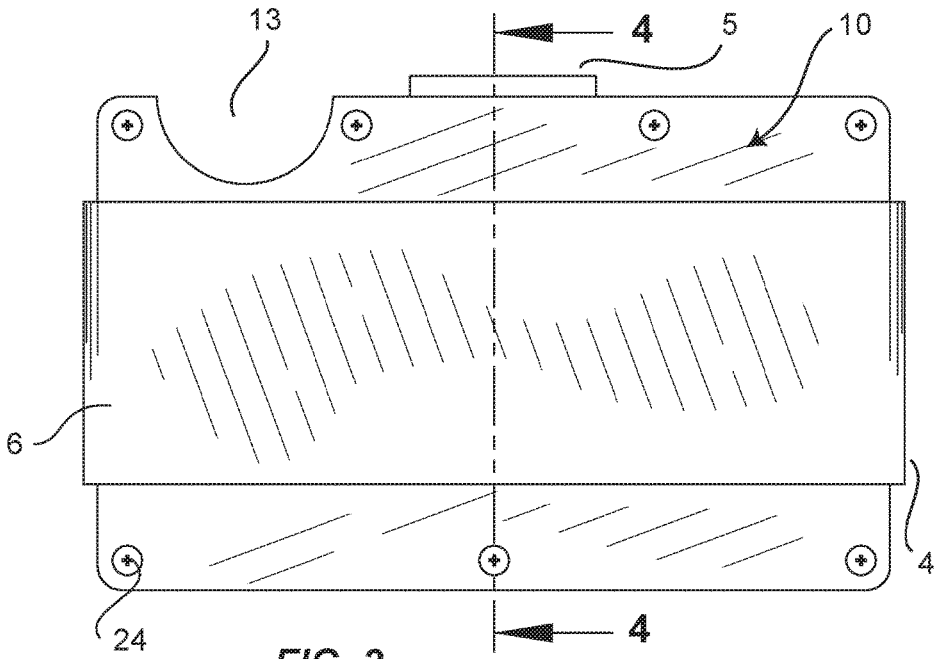
FIG. 3 is a plan view of the compact wallet.
Figure 5:
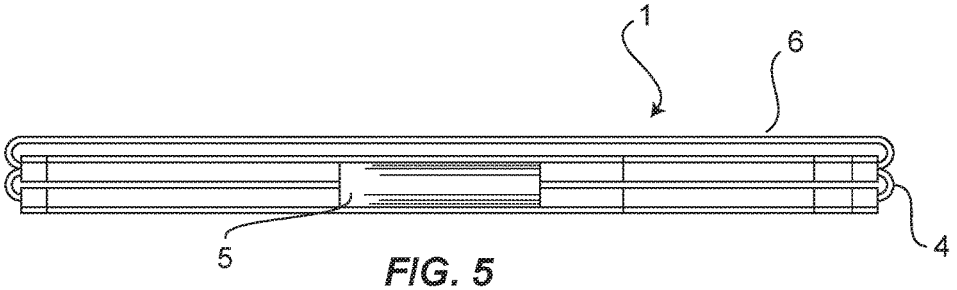
FIG. 5 is a top view of the compact wallet.
Figure 6:
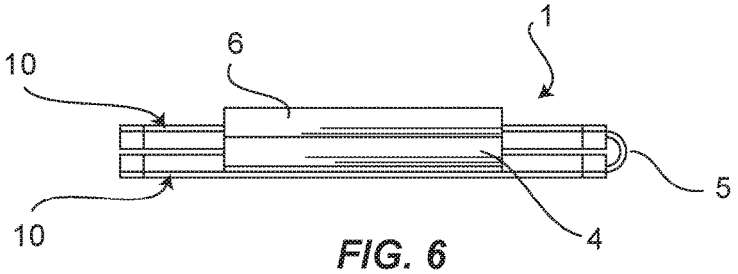
FIG. 6 is a right-side view of the compact wallet.
Figure 7:
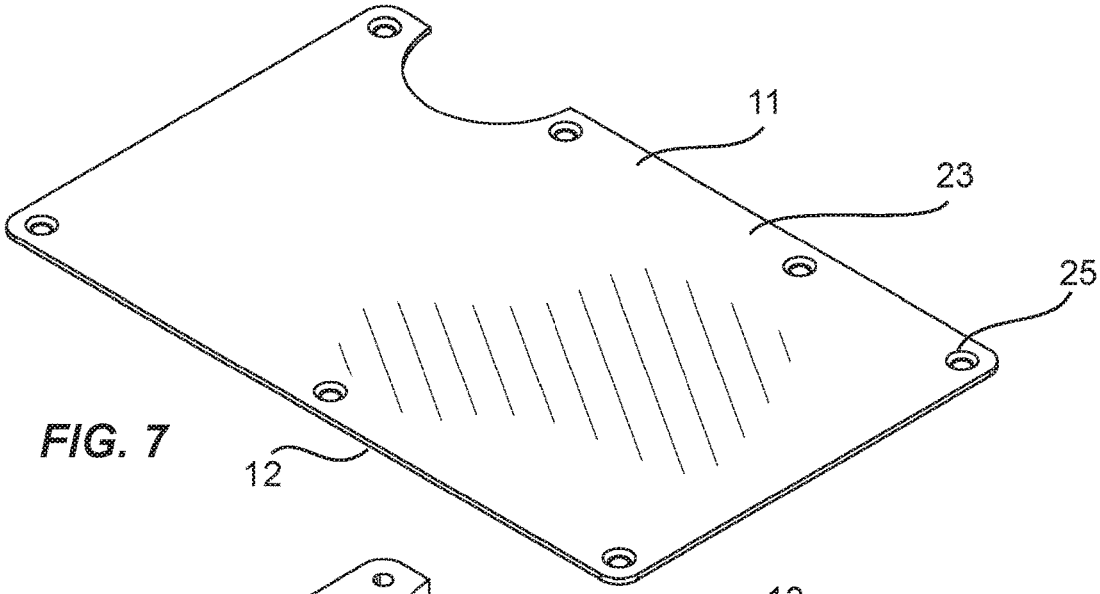
FIG. 7 is a perspective view of a second lamina of a laminate construction of one of the rigid plates.

Referring to FIGS. 1 and 2, a compact wallet 1 is comprised of at least two rigid plates 10, serving as "bookends" as it were, with one or more card-like contents 2 sandwiched between them. The sandwiched composite is bound by at least one encircling elastic band 4. The encircling elastic band 4 holds the card-like contents 2 securely by means of compression, while also expanding elastically to open space between the rigid plates 10.

The added volume of the space provides capacity for additional contents. The rigid plates 10 are sized to the dimensions of a standard credit card and the resulting perimeter defines a profile 14. A channeling means 20 prevents the encircling elastic band 4 from adding more than negligible breadth to profile 14. This profile minimization is accomplished by locating the channeling means 20 internally to the rigid plates 10. In other words, no structures projecting from the profile 14 are needed to fixture the encircling band 4, as in the case of prior art.

Referring to FIGS. 2 to 9, the channeling means 20 of the preferred embodiment is a longitudinal groove 21 spanning a longitudinal extent 3 of each rigid plate 10. The longitudinal groove 21 is of such ample dimension as to receive a corresponding part of the encircling elastic band 4 and allow it to slidingly expand and contract freely while holding position there within. In this way, the full running length of the band can be exercised for expansion while contraction is rendered responsive. The result is a maximally achievable opening between the plates whereby filling volume is optimized.

In one preferred embodiment, the longitudinal groove 21 traverses a first lamina 22 of a laminate construction of each rigid plate 10. The first lamina 22 is capped with a second lamina 23 to capture one portion of the encircling elastic band 4 and complete the channeling means 20. The second lamina 23 is preferably attached removably to the first lamina 22 to enable the encircling elastic band 4 to be changed out at the end of its service life. In a particular preferred embodiment, the attachment is made by flat-headed screws 24 threaded into threaded holes 26 in the first lamina 22 through countersunk holes 25 in the second lamina. The flat-heading and counter-sinking of the screws provide a smooth outer surface to the compact wallet 1, thereby permitting snag-free glide into pockets or other containment vessels. In an alternate embodiment, the attachment mechanism may include appropriately placed pressure sensitive adhesive strips (not shown). Other attachment means, known in the art, are also contemplated as within scope.

Figure 10:
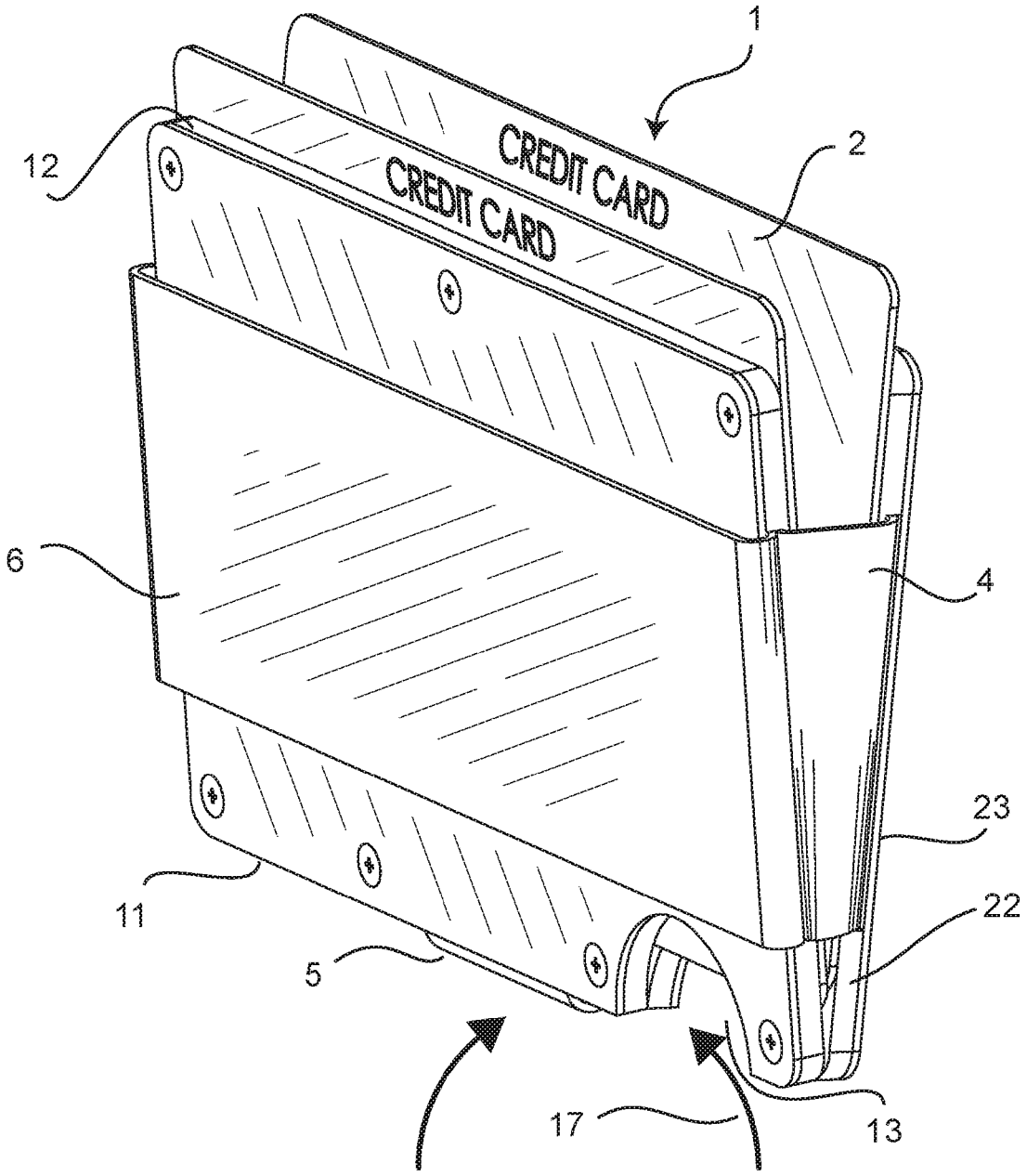
FIG. 10 is a perspective view of a fanned open compact wallet.

In one preferred embodiment shown in FIGS. 1 and 10, a finger notch 13 is provided in the periphery at a proximal end 11 of each rigid plate 10 such that the notches of facing plates are aligned. To accomplish the alignment, each plate must be configured in a mirror image of the other. The finger notches 13 expose an edge of the card like contents 2. Using a finger in the finger notch, the card-like contents 2 can be urged upwardly in a lifting maneuver 16 by pressing against the exposed edge to elevate the card-like contents above distal ends 12 of the rigid plates 10. The lifting maneuver 16 makes the card-line contents 2 available for inspection and selection, which would otherwise be difficult tasks when masked by the plates. The display of contents can be further enhanced by a pinching maneuver 17, which is accomplished by pinching the proximal ends 11 together about the fulcrum of the exposed edge of the contents rendered offset from the proximal ends 11 by the preceding maneuver. The pinching maneuver 17 fans open the distal ends 12 and facilitates separation of the card-like contents for further inspection and ease of selection.

Figure 8:
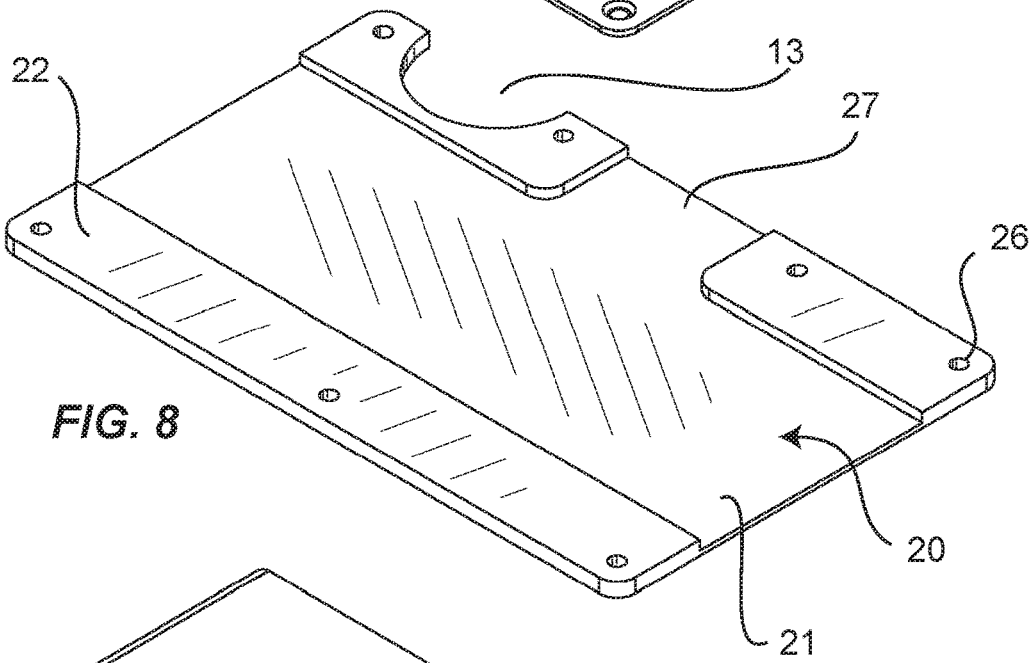
FIG. 8 is a perspective view of a first lamina of the laminate construction showing a groove for channeling an encircling elastic band.
Figure 9:
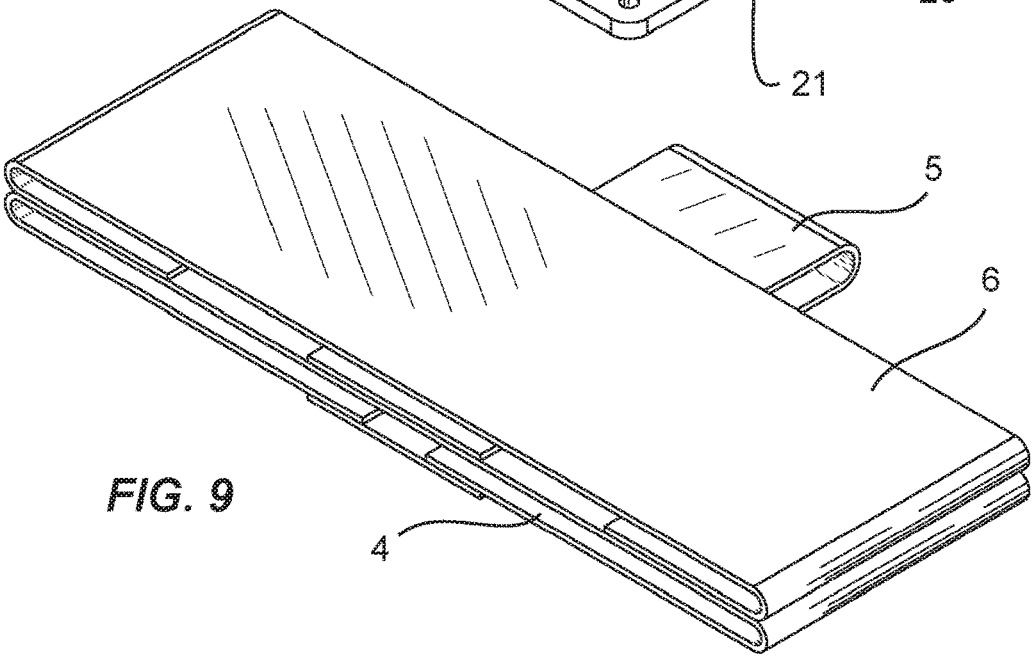
FIG. 9 is a perspective view of the elastic band showing first and second appendant straps.

In one preferred embodiment, as shown in FIGS. 3-6 and 9, a first elastic strap 5 is positioned over the proximal ends 11 of the rigid plates 10. The first elastic strap 5 registers the card like contents to the proximal ends 11 and prevents them from slipping beyond the ends when expansion takes place. Preferably, the first elastic strap 5 is attached to the encircling elastic band 4 by sewing, or bonding, by access through the transverse groove 27 (FIGS. 2 and 8). Alternatively, the first elastic strap 5 is attached to each rigid plate 10 by any known means. In one preferred embodiment, a second elastic strap 6 is positioned over the outside surface of one of the rigid plates 10 to strap thereon currency 8 (FIG. 1), or additional card-like contents 2. Preferably, the second elastic strap 6 is attached to the encircling elastic band 4 by sewing, or bonding, by access through the longitudinal groove 21. Alternatively, the second elastic strap 6 is attached to the rigid plate 10 of its intimacy by any known means.

Figure 11:
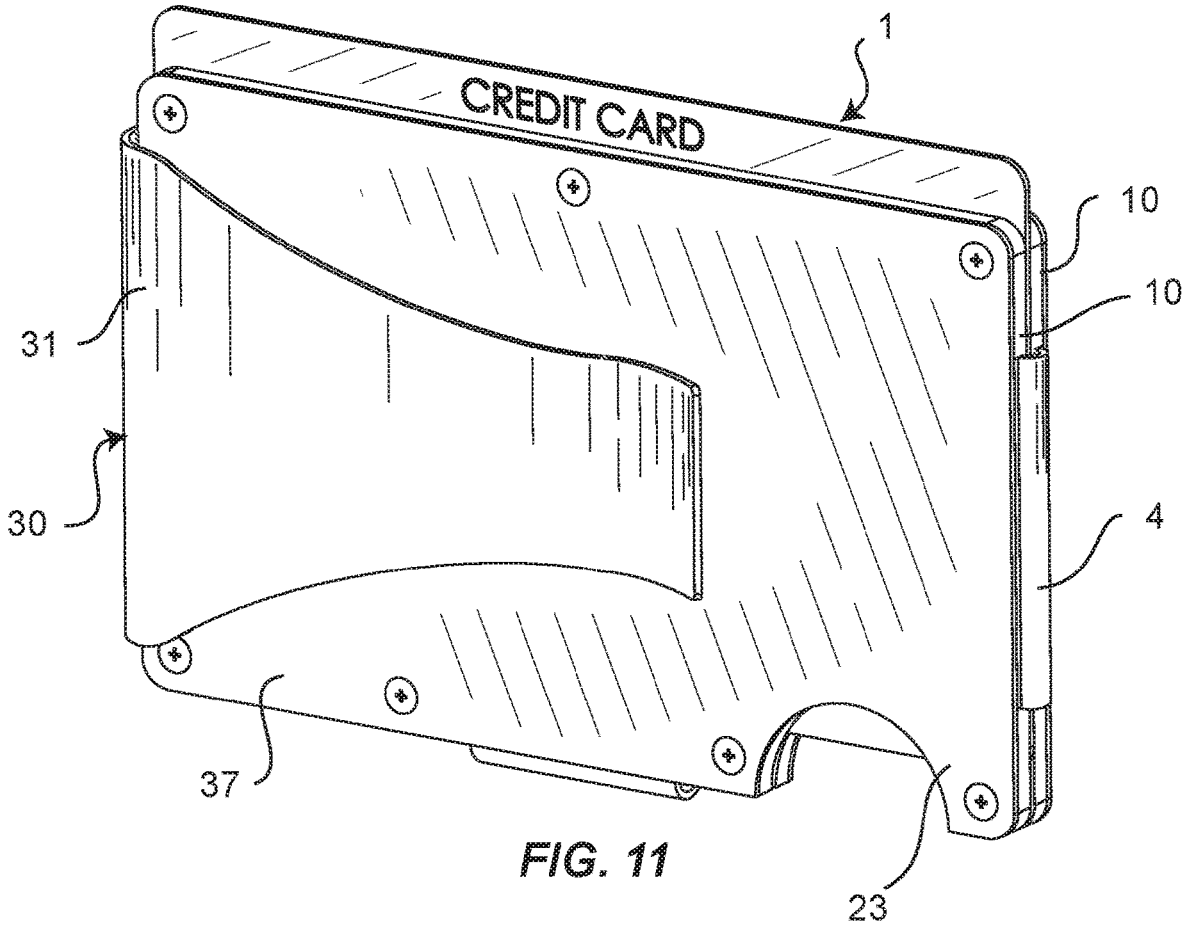
FIG. 11 is a perspective view of the compact wallet with a money clip attached.
Figure 12:
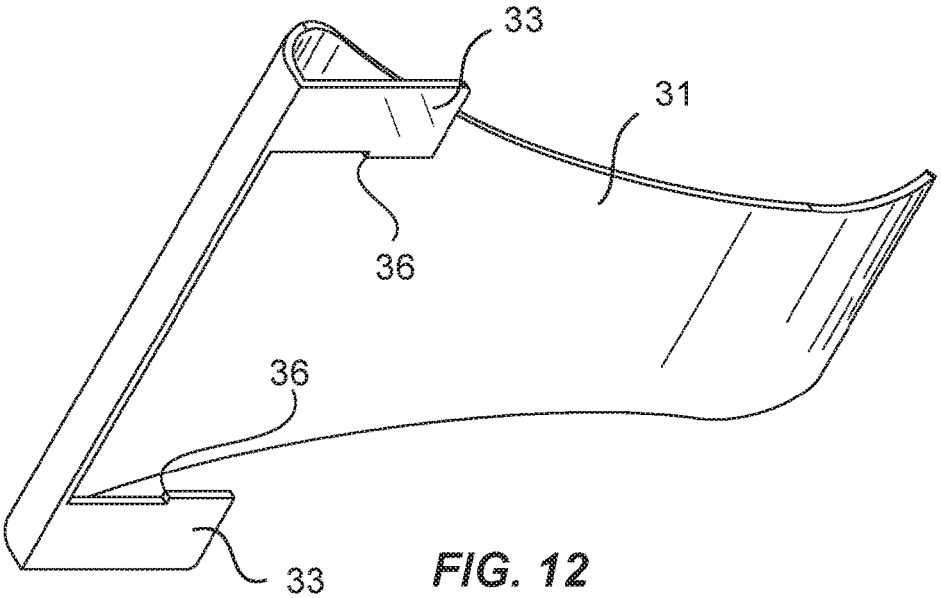
FIG. 12 is a perspective view of the money clip.
Figure 13:
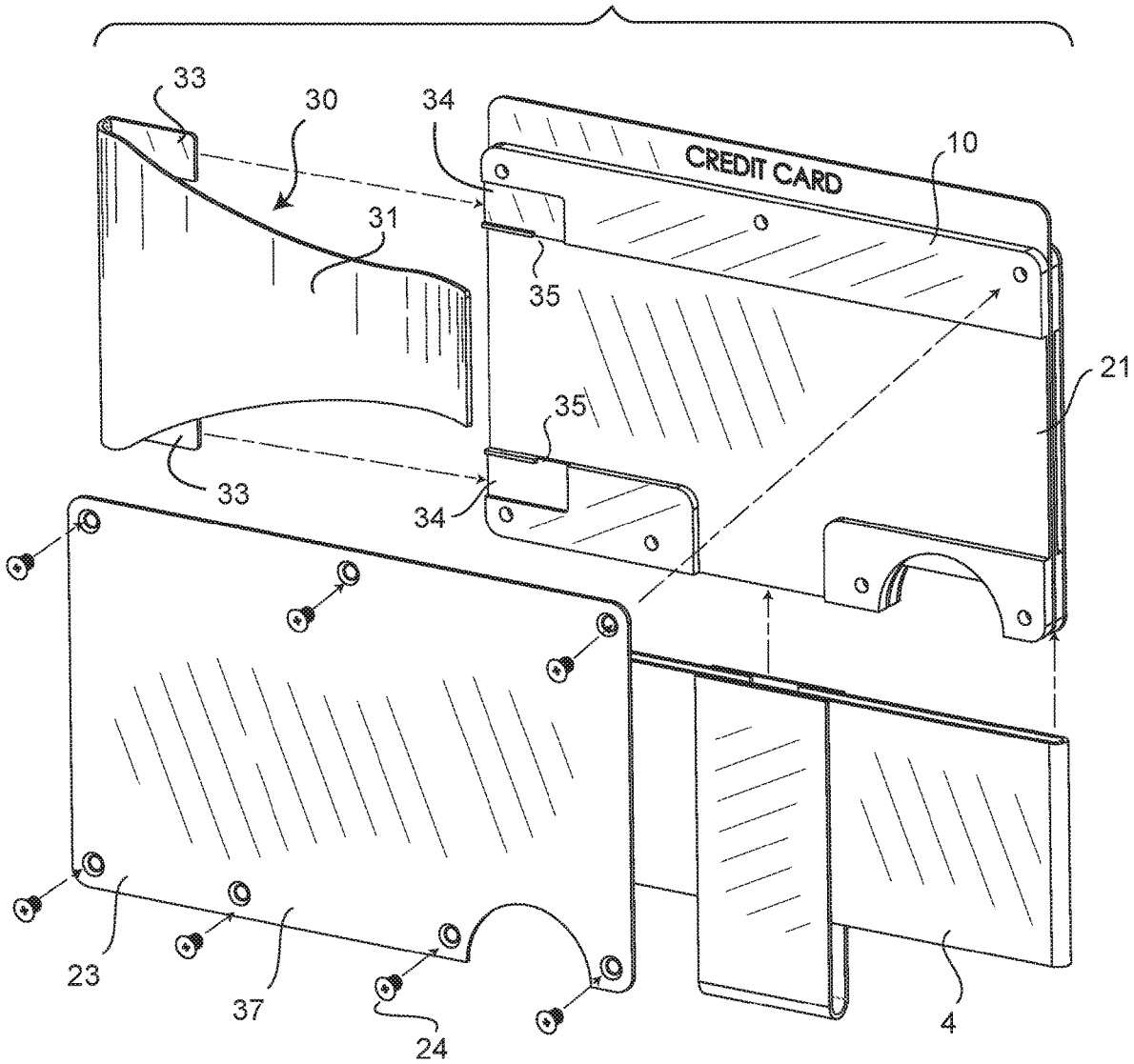
FIG. 13 is an exploded view of the compact wallet with money clip.

In one alternative embodiment, shown in FIGS. 11-13, an auxiliary feature 30 is added to at least one of the rigid plates 10 to occupy a position on an outside surface 37 thereof. Preferably, the auxiliary feature 30 is a money clip 31. Alternatively, the auxiliary feature 30 may be a windowed envelope 32 (not shown). The windowed envelope 32 may be configured to receive a driver's license, a passport card, a military ID, a Global Entry card, or any other card-like content 2 to be displayed exteriorly to the compact wallet 1 by means of a transparent window. The money clip 31 and the windowed envelope 32, while exemplifying the concept, are not otherwise considered to be scope-limiting for the auxiliary feature 30.

The auxiliary feature 30 is removably attached to at least one of the rigid plates 10 by means of a tang 33 inserted into a recess 34 in the groove 21 outboard of the elastic band 4. The outboard positioning prevents interference with the free operation of the elastic band. In a particularity, the recess 34 has an undercut 35 and the tang 33 has a hook 36 (FIG. 12). The hook 36 engages the undercut 35 to prevent inadvertent dislodgement of the auxiliary feature 30 when attached to the compact wallet 1.

In the preferred embodiment, the card-like contents include, but are not limited to, credit cards, a driver's license, ID cards, business cards, affiliation/membership cards, currency bills, loyalty cards, coupons, a calendar, receipts or any paper or card-stock item of a personal or business nature. The rigid plates 10 are either comprised of metal, or otherwise integrate a metalized surface, for radio-frequency identification (RFID) theft protection purposes, as credit cards are increasingly using RFID chips. A substrate can be metalized by electric deposition, by casting, or otherwise by bonding on or taping on a foil. In the preferred embodiment, the first lamina 22 is fabricated from aluminum plate of 2 mm gauge by machining. Alternatively, the first lamina 22 may be 316 stainless steel (SS), or may otherwise be injection molded with high-impact polystyrene (HIPS), acrylonitrile butadiene styrene (ABS) or any resin with stiffness property. The second lamina 23 may be fabricated from similar materials and methods as the first lamina 22, although not necessarily matched thereto. For example, the second lamina 23 may be die-cut from polystyrene sheet stock of 0.7 mm gauge and mated with machined SS from plate stock used for the first lamina 22. The rigid plates 10, and the profile 14 by definition, preferably measure approximately 8.5 cm by 5.4 cm. In the preferred embodiment, the flat-headed screws 24 are comprised of 316 SS; but may also, in the alternative, be made of aluminum or any other metal alloy. The encircling elastic band 4, the first elastic strap 5 and second elastic strap 6 may be any rubber, or rubberized, material configured in a web. In the preferred embodiment, the band and straps are of 3 cm woven elastic fabric, such as that found at the John Howard Company. Alternatively, the bands and straps may differ from each other in materials and sizes.

The compact wallet 1 may be provided at retail in a system configuration with a tool, such as a driver (not shown), to assist with assembly or disassembly. The system may also include an instruction card (not shown), or pamphlet, a spare encircling elastic band 4 or one or more spare flat-headed screws 24. The compact wallet 1 may supplied either assembled or disassembled in the system configuration.

One alternative embodiment is a method of making a modular compact wallet, said method comprising these steps:

i. providing one or more of the embodiments of the compact wallet 1 as discussed above;

ii. providing a first auxiliary feature 30 having at least one tang 33;

iii. inserting, removably, the at least one tang 33 of the first auxiliary feature 30 into at least one recess 34 to make the first auxiliary feature 30 available at an outside face 37 of at least one rigid plate 10;

iv. removing, selectively, the first auxiliary feature 30;

v. providing, selectively, at least a second auxiliary feature 30 having at least one tang 33; and vi. inserting, removably, the at least one tang 33 of the second auxiliary feature 30 into the at least one recess 34 to make the second auxiliary feature available at the 20 outside face 37 of at least one rigid plate 10.

The beneficial method discussed above provides additional functionality to the compact wallet 1 by modularly positioning, opportunistically, an alternative feature on the outside of the compact wallet, where such a feature would be readily accessible and in view for visual inspection.

It is to be understood that the invention is not limited in its application to the details of construction and to the arrangements of the components set forth in the preceding description or illustrated in the drawings. For example, the channeling means 20 might be a longitudinal bore through each rigid plate 10. Also, it is to be understood that the phraseology and terminology employed herein are for the purpose of the description and should not be regarded as limiting.

It is claimed:

1. A compact wallet, comprising:

a first rigid plate and a second rigid plate, wherein when assembled the first rigid plate and the second rigid plate are mirror images of one another, and wherein the first rigid plate and the second rigid plate each include a first lamina and a second lamina, wherein the first lamina includes a longitudinal groove and at least one threaded hole, and the second lamina includes at least one countersunk hole, at least one flat head screw configured to thread into the at least one threaded hole through the at least one countersunk hole, at least one encircling elastic band housed within the longitudinal groove to bias the first rigid plate and the second rigid plate inwardly and securely hold the card-like contents while providing an expandable volume between the first rigid plate and the second rigid plate, an elastic strap attached to the encircling elastic band to register the card-like contents, a first finger notch adjacent to the elastic strap associated with the first rigid plate, a second finger notch adjacent to the elastic strap associated with the second rigid plate, and a money clip removably attached to the first rigid plate or the second rigid plate, wherein the money clip includes a tang insertable into a recess formed inside the first rigid plate or the second rigid plate.

2. The compact wallet of claim 1, further comprising at least one adhesive strip between the first lamina and the second lamina of at least one of the first rigid plate and the second rigid plate.

3. The compact wallet of claim 2, wherein the at least one adhesive strip is pressure sensitive.

4. The compact wallet of claim 1, wherein the at least one countersunk hole is configured to align with the at least one threaded hole.

5. The compact wallet of claim 1, including at least seven countersunk holes in the second lamina.

6. The compact wallet of claim 1, including at least seven threaded holes in the first lamina.

7. The compact wallet of claim 1, wherein the longitudinal groove is configured to slidingly receive the at least one encircling elastic band.

8. The compact wallet of claim 1, wherein at least one of the first or second lamina of the first rigid plate and the second rigid plate is comprised of metal for RFID protection.

9. The compact wallet of claim 8, wherein the second lamina of the first rigid plate or the second rigid plate is comprised of metal for RFID protection.

10. The compact wallet of claim 1, wherein at least one of the first or second lamina of the first rigid plate or the second rigid plate is metalized for RFID protection.

11. The compact wallet of claim 10, wherein the second lamina of the first rigid plate or the second rigid plate is metalized for RFID protection.

12. The compact wallet of claim 1, wherein the card-like contents includes at least one selected from the group consisting of a credit card, a driver's license, an ID card, a business card, an affiliation card, a currency bill, a loyalty card, a coupon, a receipt or a personal paper.

13. The compact wallet of claim 1, wherein at least one of the first finger notch and the second finger notch is configured to expose an edge of the card-like contents for the purpose of pushing the edge to elevate the card-like contents into view.

14. The compact wallet of claim 1, wherein the encircling elastic band is comprised of woven elastic fabric.

* * * * *